US006619879B1

(12) United States Patent
Scuero

(10) Patent No.: US 6,619,879 B1
(45) Date of Patent: Sep. 16, 2003

(54) METHOD AND DEVICE FOR THE WATERPROOFING OF JOINTS AND CRACKS IN HYDRAULIC WORKS, CONCRETE AND MASONRY STRUCTURES

(75) Inventor: Albert Scuero, Castel San Pietro (CH)

(73) Assignee: Capri Tech Italia S.R.L., Arona (IT)

( * ) Notice: Subject to any disclaimer, the term of this patent is extended or adjusted under 35 U.S.C. 154(b) by 0 days.

(21) Appl. No.: 09/857,791

(22) PCT Filed: Dec. 6, 1999

(86) PCT No.: PCT/EP99/09535

§ 371 (c)(1),
(2), (4) Date: Aug. 22, 2001

(87) PCT Pub. No.: WO00/34588

PCT Pub. Date: Jun. 15, 2000

(30) Foreign Application Priority Data

Dec. 10, 1998 (IT) ..... MI98A2657

(51) Int. Cl.[7] ..... E01C 11/02
(52) U.S. Cl. ..... 404/74; 404/72
(58) Field of Search ..... 404/47, 67, 68, 404/69, 72, 74; 52/741.4; 14/73.1

(56) References Cited

U.S. PATENT DOCUMENTS 3,659,390 A * 5/1972 Balzer et al. ..... 404/69
4,533,278 A * 8/1985 Corsover et al. ..... 404/65
4,793,162 A * 12/1988 Emmons ..... 156/71
5,082,394 A * 1/1992 George ..... 404/57
5,171,100 A * 12/1992 Bergstedt et al. ..... 403/225
5,197,250 A * 3/1993 Kramer ..... 404/65
5,464,304 A * 11/1995 Dittmar ..... 404/75
5,513,925 A * 5/1996 Dempsey et al. ..... 404/17
5,749,674 A * 5/1998 Wilson, Sr. ..... 404/75
5,935,683 A * 8/1999 Iiyama et al. ..... 156/71
6,103,356 A * 8/2000 Messenger ..... 428/215

FOREIGN PATENT DOCUMENTS

AT 375 984 9/1984
DE 27 34 514 A 2/1979
DE 195 18 732 A 11/1996

OTHER PUBLICATIONS

*Patent Abstracts of Japan*, vol. 008, No. 028 (M–274) , Feb. 7, 1984.

* cited by examiner

*Primary Examiner*—Gary S. Hartmann

(57) ABSTRACT

A method for the waterproofing of joints and/or cracks in the upstream face of dams, other hydraulic works and concrete or masonry structures. A waterproofing membrane includes a strip of elastically yielding synthetic material that is fastened to the surface to be protected along the whole joint and/or crack. Prior to positioning the waterproofing membrane, sliding elements are positioned onto the surface to support the membrane. A protection and sliding substrate is properly fastened independently from the waterproofing membrane so that the waterproofing membrane is allowed to freely elongate and follow the movements of the joint and/or the crack while maintaining a water tightening condition.

20 Claims, 4 Drawing Sheets

METHOD AND DEVICE FOR THE WATERPROOFING OF JOINTS AND CRACKS IN HYDRAULIC WORKS, CONCRETE AND MASONRY STRUCTURES

FIELD OF THE INVENTION

This invention refers to the waterproofing of hydraulic structures such as roller compacted concrete dams (RCC dams), concrete gravity dams and masonry gravity dams, embankment dams with a concrete waterproofing upstream facing, canals, tunnels, reservoirs and similar, and of concrete and masonry structures in general. In particular, this invention concerns a method for the waterproofing of contraction and/or construction joints, deteriorated joints and/or cracks, here in after referred to also as "joints" or "cracks" in the concrete or masonry lining or body of hydraulic structures as well as in the concrete and/or masonry structures of the type previously referred to, having a surface in contact with water or a surface with joints and/or cracks through which water seepage can occur; the invention also relates to a layered waterproofing covering device for joints, cracks and the like, obtained by the waterproofing method mentioned above.

According to well known concepts, in the construction of hydraulic structures, for example of concrete dams or roller compacted concrete dams, or in the construction of embankment dams, both earthfill and rockfill, it is necessary to provide a proper waterproofing of the upstream face in order to prevent water seepage from the reservoir, which represents an economic loss and which can compromise the integrity and the stability of the dam body itself.

The constructive methodology of dams and hydraulic structures, or of concrete or masonry structures of any type, has therefore to take into account the shrinkage and thermal expansion phenomena, and the movements due to settlement or to other causes which the hydraulic structure or the concrete structure can undergo over time, for example at variation in hydraulic load on the upstream side of a dam, which can cause the opening or widening of the joints of the concrete waterproofing liner, or the formation of dangerous cracks through which seepage of water could occur.

In particular, in the design and construction of RCC dams it is necessary to consider the deformations induced by the hydration process of the concrete because, after reaching the maximum hydration heat, the decrease of the temperature of the dam body until it reaches a stable condition, is accompanied by contraction phenomena of the concrete volume, which can cause cracking.

Therefore, in these hydraulic structures it is necessary to provide proper contraction joints in order to avoid that uncontrolled cracking can occur.

The contraction joints generally create preferential lines for the formation of cracks in the upstream face of the dam, due to the contraction of the concrete, which develop vertically parallel to the slope.

The contraction joints also undergo some movements, generally to a lesser extent, even after the concrete has reached its equilibrium temperature. These movements can be caused by the variations of the water level in the reservoir, by seismic phenomena, or by other causes.

In general, joints and/or cracks represent a discontinuity in the concrete or masonry waterproofing liner of the upstream face of a dam or of any hydraulic structure or other structure. Therefore this discontinuity must be treated so as to avoid possible water seepage.

STATE OF THE ART

The traditional systems which are at present adopted for the waterproofing of joints and/or cracks usually foresee the use of synthetic or copper material, the so-called "waterstops", arranged in single or double rows, embedded in the concrete as it is being cast during the construction of the hydraulic structure or other structure, and therefore they interfere with the constructive process.

In general, the employment of the known waterproofing systems, besides interfering with the constructive process, makes it quite difficult to intervene for any maintenance or repair operation, when joints deteriorate. As a matter of fact, these systems generally do not provide a proper waterproofing, durable over time and capable of compensating movements or settlements that should occur in the body of the hydraulic structure or of the concrete and/or masonry structure, without losing their fundamental waterproofing characteristics.

While the contraction joints in RCC dams or the construction joints in concrete dams or similar hydraulic works represent a discontinuity induced in the concrete waterproofing liner, and therefore waterproofed since the construction of the hydraulic work itself, other casual discontinuities can occur during operation, when, for any reason, the concrete or the masonry crack, or the waterstops waterproofing the joints deteriorate over time or for accidental causes.

Therefore, this cracks or deterioration, if not properly protected and checked, can cause water seepage, with damaging consequences.

OBJECTS OF THE INVENTION

The general object of this invention is to provide a method for the waterproofing of joints and/or deteriorated joints and/or of cracks in the concrete liners of hydraulic structures such as dams or similar, and in concrete and/or masonry structures, which can remedy the inconveniences of waterproofing systems previously in use.

More in particular, an object of this invention is to provide a waterproofing method as referred to above, which is quite independent from the constructive process of the hydraulic structure or structure and which can be applied subsequently.

Another object of the invention is to provide a method for the waterproofing of joints and/or cracks as mentioned above, which has such a high degree of elastic deformability and of independence of its components, that it can follow any movement which should occur in joints or cracks, subsequent to the movements of the dam body or the hydraulic structure to be protected and/or repaired, without losing the waterproofing and mechanical resistance characteristics.

A further object of the invention is to provide a waterproofing of joints, cracks and the like as previously defined, which is external to the hydraulic structure or other type of structure and which therefore allows control and repair interventions after its installation.

The invention is also aiming to employ a membrane in elastically yieldable synthetic material, for the waterproofing of contraction joints, construction joints, cracks and the like, in particular in the upstream faces or in existing surfaces which get in touch with water in hydraulic structures such as RCC dams, concrete dams, embankment dams having a concrete upstream face, tunnels, water conveyance structures, reservoirs and similar hydraulic structures.

BRIEF DESCRIPTION OF THE INVENTION

What has been previously mentioned can be provided by means of a method for the waterproofing of joints and/or cracks in the concrete and/or masonry linings or body of hydraulic structures, masonry structures and similar, as well as with a waterproofing covering device for joints, cracks and the like.

In particular, according to the invention, a method has been provided for the waterproofing covering of joints and/or cracks in hydraulic structures, masonry structures and similar, by means of a waterproofing membrane comprising a strip of elastically yieldable synthetic material, which is positioned along a joint or crack on an existing surface of the hydraulic and/or masonry structure to be protected, comprising the steps of:

positioning at least one support element of rigid material on the existing surface of the hydraulic and/or of the masonry structure, to cover the joint and/or crack, and to provide a support surface for the membrane, anchoring said support element across the joint and/or the crack to allow a sliding movement in respect to said existing surface;

positioning at least one protection substrate for the membrane, over the support element, between the latter and the membrane to allow a sliding movement of the same membrane in respect to the support element and the existing surface;

placing the waterproofing membrane over the protection substrate and the support element; and watertightly fastening the peripheral edges of the membrane to the existing surface of the hydraulic and/or of the masonry structure, along the sides of the joint and/or the crack.

According to another aspect of this invention, over the waterproofing strip of the membrane it is possible to install a protection slab, preferably in steel or another proper material, to cover the waterproofing strip along its whole development or along only a portion of it, anchoring this protection slab in such a way as to allow it independently move in respect to the waterproofing membrane. Should the membrane be employed to waterproof a crack through which water can seep from the back side, the protection slab can be used for frontally supporting the same membrane and avoid its swelling.

According to another aspect of this invention, it is preferable to extend the waterproofing of the joint to waterproofing a concrete beam at the dam heel, extending and positioning the waterproofing covering membrane on a foundation beam, watertightly anchoring the membrane in correspondence of the area where the joints of the foundation beam, if any, are waterproofed.

According to another aspect of the invention a waterproofing covering device for joints and/or cracks on an existing surface of hydraulic or masonry structures has been provided, said covering device comprising:

at least a support element longitudinally extending for at least a portion of the joint or crack, said support element being fastened to the existing surface, so that it can slide in respect to said surface;

a waterproofing membrane comprising a strip of elastically yieldable material, longitudinally extending over the support element and tightly fastened to the existing surface on both sides of the joint or crack;

an intermediate protection substrate between the waterproofing membrane and the support element; and fastening means for water tightly fastening the waterproofing membrane to the existing surface on both side of the elastically yieldable strip.

BRIEF DESCRIPTION OF THE DRAWINGS

These and other characteristics of the method and the covering for the waterproofing of joints and/or cracks in the concrete waterproofing liners of dams and similar structures, will better result from the description and the examples of the attached drawings, in which.

DETAILED DESCRIPTION OF THE INVENTION

We will describe here below the general principles of the method for the waterproofing of joints and/or cracks according to the invention, by means of a waterproofing membrane, referring as an example to a roller compacted concrete dam, without intending this example in a restrictive way, since the waterproofing method described can be applied to any concrete and/or masonry structure; for the aims of this invention, "waterproofing membrane" means a strip of prefixed width, obtained from a synthetic, waterproofing and elastically yieldable material, such as PVC, PP, PE and similar synthetic material.

CONTRACTION JOINTS OF RCC DAMS

Figure 1:
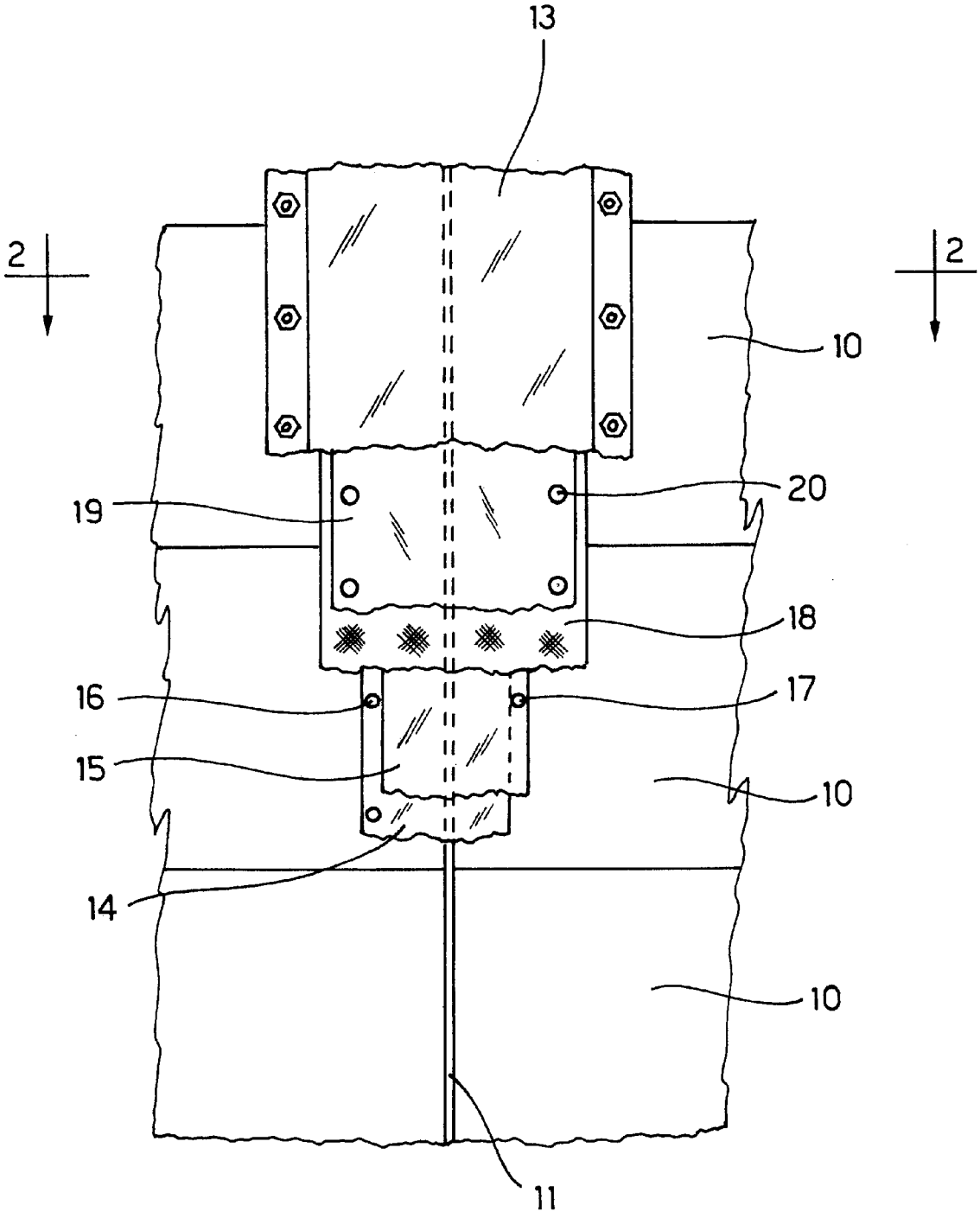
FIG. 1 is a front view of an area of the upstream face of a RCC dam, provided with a waterproofing covering for a contraction joint according to the invention.

FIG. 1 shows a front view of the upstream face 10 of an RCC dam consisting of superimposed layers of roller compacted concrete; during the construction of the layers, contraction joints 11 are formed, which extend vertically, parallel to the slope of the upstream face, for the whole height of the dam body.

Figure 2:
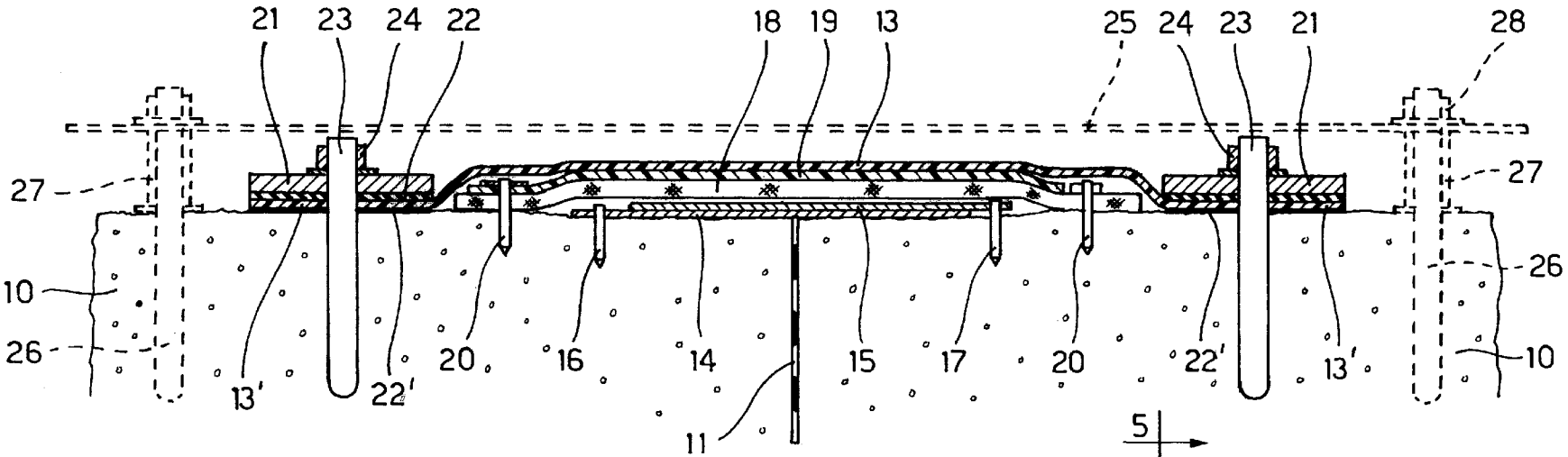
FIG. 2 is an enlarged cross-sectional view, made along line 2—2 of FIG. 1.
Figure 4:
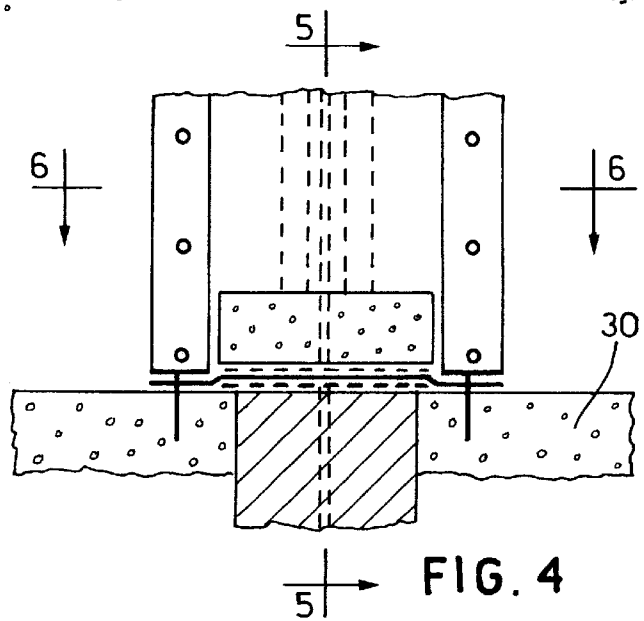
FIG. 4 is a front view of the waterproofing covering, in correspondence of a foundation beam.

As shown in FIG. 2, the contraction joint 11 prolongs inside the concrete body of the single layers 10, so as to constitute a preferential line for cracking.

DESCRIPTION OF THE METHOD

As shown in the two above-mentioned figures, the method for the waterproofing of joint 11 foresees the use of a strip of waterproofing membrane 13, of suitable width, obtained from a sheet of flexible and elastically yieldable material, with a low permeability, which is installed on the whole vertical development of joint 11 so that it entirely covers it, if needed prolonging it in correspondence with the dam heel in order to allow the connection with the waterproofing system of a curb or a foundation beam, as it will be further explained.

Strip 13 of waterproofing material is installed external to the upstream face 10 in order not to interfere with the construction of the dam.

In order to adequately support the waterproofing membrane 13 and to avoid the membrane to be damaged by puncturing or intrusion in the crack, according to this invention it is foreseen to previously install a suitable support element for supporting the membrane 13 which prevents the intrusion of the same membrane 13 into the joint 11 under the thrust of the hydraulic load of the water impounded in the upstream reservoir, or due to any movement of the dam body.

The support element for supporting the waterproofing membrane must be executed in such a way as to be able to follow the maximum allowed opening movements of the contraction joint 11 under the maximum foreseen hydraulic load, and the subsequent closing movements, without interfering with the strip of the waterproofing membrane.

The support element can consist of one or more rigid plates in steel or another kind of material, connected to the concrete body of the upstream face, and placed across joint 11 so as to allow relevant movements.

More precisely, in the example shown in FIGS. 1 and 2, the support element consists of two plates 14 and 15, partially overlapped; each plate is fastened at spaced apart points, along only one lateral edge, by means of anchoring rods, respectively 16 and 17, so as to allow free sliding of the two plates one over the other during the opening and closing movements of joint 11, while allowing support of membrane 13.

The two supporting plates 14 and 15 consist of one or more shaped portions, axially aligned, which extend for the whole length of joint 11.

In order to prevent the waterproofing membrane 13 from any failures or puncturing actions caused by the supporting plates 14 and 15, and in order to grant the independence of movement between the support plates and the same membrane, one or more protection and sliding substrates are interposed, between the supporting plates and the waterproofing membrane 13, said substrates being fastened to the concrete body of the upstream face 10, on both side of the supporting plates 14, 15.

More precisely, as shown in FIGS. 1 and 2, immediately over the supporting plates 14 and 15, a transition substrate 13 of considerable thickness is provided, for examples having a weight from 0.5 to 3 $Kg/m^2$, comprising a synthetic sheet material, preferably a geotextile with great mass per unit area; over the transition substrate 16 a second sliding substrate 19 is overlapped, in geosynthetic material, for example constituted by a strip of the same material used for the membrane 13 waterproofing the joint, in order to grant a free sliding movement of the same membrane in respect to the joint. Both the protection substrate 18 and the sliding substrate 19 are fastened at spaced apart points to the concrete existing surface 10 by means of anchoring rods 20.

Therefore the two substrates 18 and 19 have a double function, namely: the protection layer or layers 18, in geotextile or other suitable material, avoid that the mutual sliding of the two supporting plates 14 and 15 interferes with the waterproofing strip 13, damaging it for example because of the puncturing action of the edges of the plates themselves, while the sliding substrate 19, besides constituting a further mechanical support and additional protection for strip 13 of the waterproofing membrane, allows also a free sliding of the membrane over substrates 18 and 19 and over the supporting plates 14 and 15 during the dilatation and contraction movements of joint 11.

As shown in the enlarged section of FIG. 2, strip 13 of the waterproofing membrane is watertight fastened against the concrete existing surface of the facing, along its lateral edges, in a way totally independent from the substrates 18 and 19 and the supporting plates 14 and 15.

For this purpose, metal profiles 21 have been applied along the lateral edges of membrane 13; these profiles tightly press the edges 13' of the membrane against the surface of the upstream face 10, also foreseeing the interposition of a suitable watertight gasket 22.

The face or surface on which the watertight fastening is constructed is previously regularised by the application of proper material 22', such as epoxy resins and similar.

The metal profiles 21 are fastened by means of threaded rods 23 anchored in the concrete, on which the blocking nuts 24 are screwed with interposition of suitable washers.

In this way a continuous watertight line is constructed along the two edges of the waterproofing membrane 13.

As previously described, the waterproofing method employs, as a waterproofing element, a flexible synthetic, elastically yieldable, in form of a strip comprising one or more sections suitably welded one to the other, which extends for the whole length of the contraction joint 11; the waterproofing membrane 13 is preferably composed by a geocomposite consisting of a low permeability synthetic geomembrane coupled to a geosynthetic material having different properties. Therefore only the waterproofing geomembrane is exposed to the action of the reservoir, while the coupled geocomposite is suitably protected and constitutes a further antipuncturing and supporting layer which increases the dimensional stability of the geomembrane itself.

The flexibility and the elasticity of the synthetic geomembrane and of the system by which it is fastened to the dam concrete face, over joint 11 to be protected, are such as to allow the membrane to elastically deform along its entire extension, following the opening and closing movements of joint 11 under the maximum foreseen hydraulic load, or due to other causes.

As shown in FIG. 2, over the waterproofing membrane 13, slightly detached from it, it is possible to add an additional protection which substantially consists of a shield 25 which extends for the entire length of the waterproofing membrane and beyond its lateral edges, for example a steel slab separately and independently fastened to the upstream face by means of anchoring rods 26, slab 25 being supported by means of spacers 27 and bolts 28 that can be screwed on the threaded end of the rods.

Figure 3:
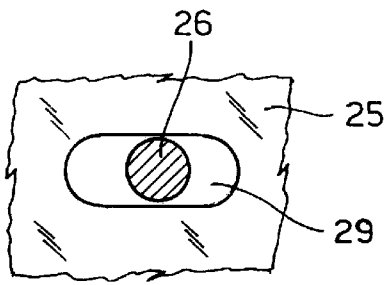
FIG. 3 is an enlarged detail of FIG. 2.

In order to allow the protection shield 25 a sliding movement independent from the movement of the protection membrane, on one side of shield 25 the anchoring rods 26 are placed through holes 29, which are oval-shaped or have larger dimensions, to allow a relative movement in transverse and/or longitudinal direction in respect to the protection shield 25 as seen in FIG. 3.

Connection to the foundation beam

Figure 5:
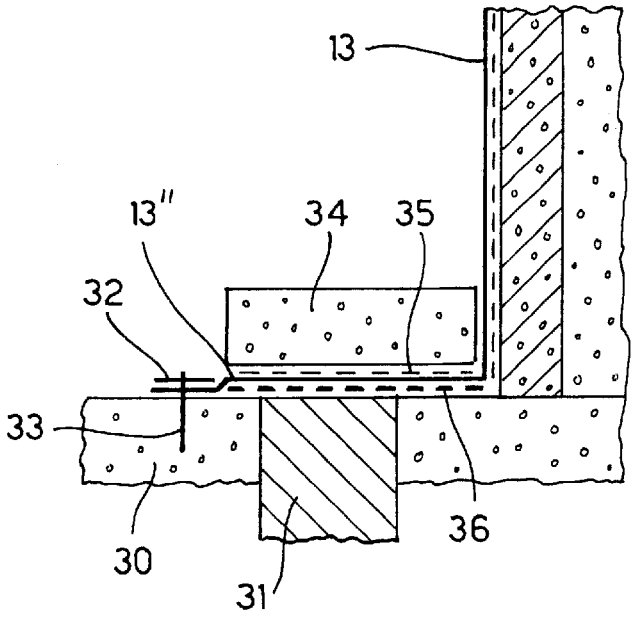
FIG. 5 is a longitudinal sectional view along line 5—5 of FIG. 4.
Figure 6:
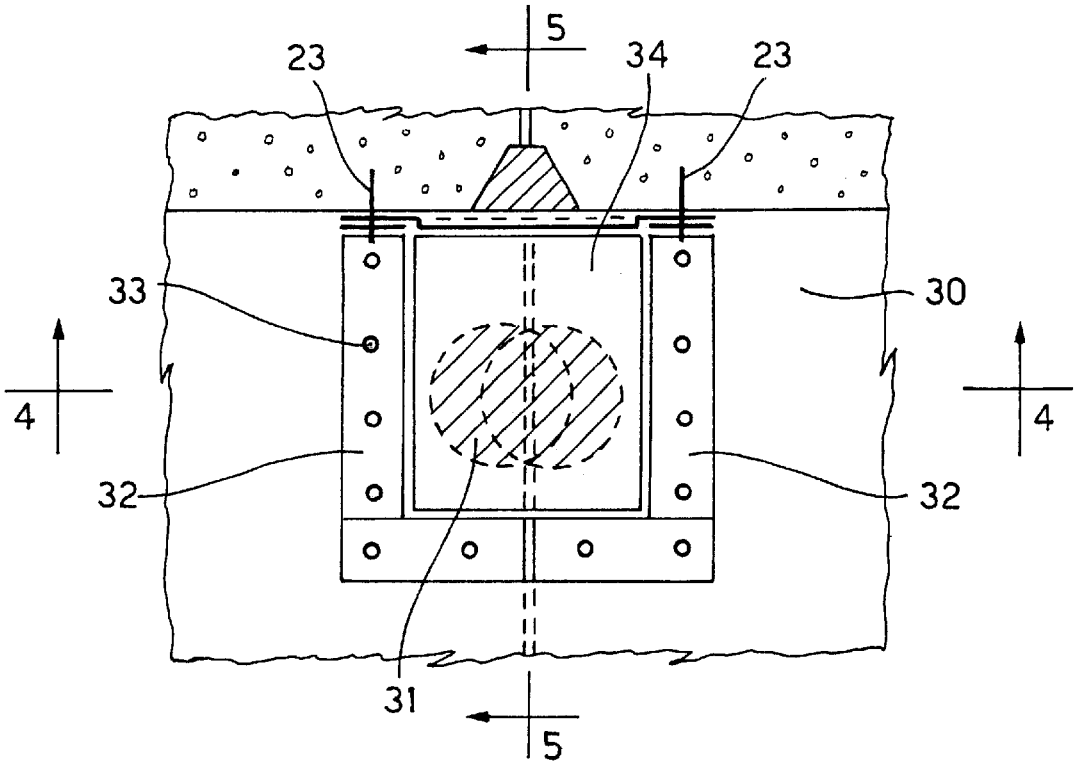
FIG. 6 is a view made along line 6—6 of FIG. 4.

As previously described, the membrane 13 for the waterproofing of the joint can be extended in correspondence of the dam heel so as to allow the connection with the waterproofing system of a curb or a foundation beam, as schematically represented in the example of FIGS. 5 and 6 of the attached drawings.

The connection is executed by extending and positioning membrane 13 over the foundation beam 30 to which it is fastened by means of proper mechanical anchoring profiles.

The flat 13" of the membrane is extended on the beam 30 for a brief stretch of 30–40 cm, in any case so long as to be sufficient to overlap on area 31 where the waterproofing of a joint in the foundation beam may have been executed, for example by injection into a proper sump of epoxy resins or similar, or by waterstops in PVC or similar.

As shown in FIGS. 5 and 6, flap 13" of the membrane is watertight anchored along its three edges by means of metal profiles 32 which are fastened by means of anchoring rods 33. A ballast 34 can be placed on the folded part 13" of the waterproofing membrane, upon previous interposition of further protection synthetic material 35, in order to allow a close contact between the waterproofing membrane and the grout curtain.

The flap 13" of the membrane can be physically connected to material 31 waterproofing the beam joints, for example by means of an adhesive 36 or by welding, according to the material employed.

With this configuration, the waterproofing of the joint is connected with the beam at the dam heel, achieving a continuity between the waterproofing of the joint on the upstream face, the waterproofing of the foundation beam, and the grout curtain that is generally provided in the foundation beam towards the underlying ground.

The upper fastening of membrane 13 is similar to the lateral ones which have already been described.

Other applications

The waterproofing method for joints, previously described, beside being suitable for waterproof the contraction joints in RCC dams, can also be employed for restoring waterproofing in correspondence of deteriorated construction joints of concrete dams, or of cracks which should occur over time, for different causes, in the faces of concrete dams, or in the concrete face of embankment dams, or in the faces of other concrete or masonry structures.

The waterproofing method results substantially identical to the previously described one and can be applied both at the end of construction of the dam, and as a rehabilitation intervention to waterproof joints of existing hydraulic structures, as well as cracks produced by the deterioration of concrete. Should the waterproofing not be extended over the foundation beam, the perimeter fastening of the membrane at bottom is similar to the one adopted for watertight fastening the lateral edges.

Figure 7:
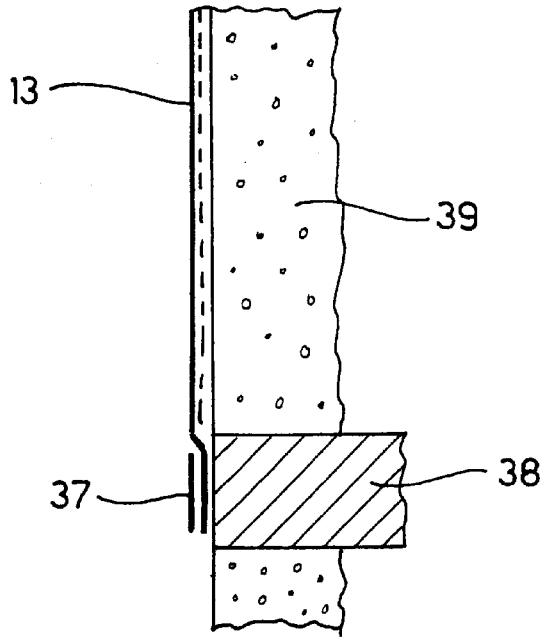
FIG. 7 shows the connection between the waterproofing membrane according to the invention and the original defective waterproofing of a pre-existing joint or crack.
Figure 8:
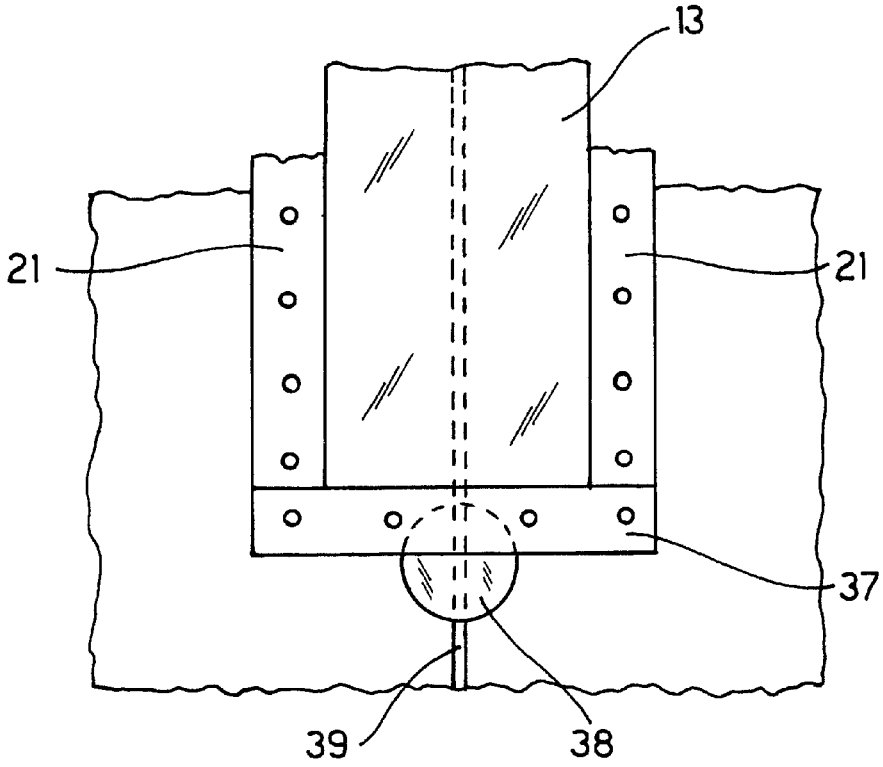
FIG. 8 is a front view of FIG. 7.

FIGS. 7 and 8 of the attached drawings show the perimeter anchorage 37 at the bottom of a waterproofing membrane 13 should this membrane not reach the foundation beam 30 or the heel of the hydraulic structure. In this case it is possible to connect the waterproofing obtained with membrane 13 in the above-mentioned way, to a pre-existing joint 39 which has deteriorated, or to a crack, by means of injecting a sealing material 38 into a hole which has been put in contact with the crack or the defective joint 39.

From what has been said and shown in the attached drawings, it will therefore be evident that we have provided a method for the waterproofing of joints for roller compacted concrete dams, concrete dams, or embankment dams with a concrete upstream face, and for the waterproofing of deteriorated joints and/or cracks in concrete and/or masonry structures.

Hence, what has been said and shown with reference to the attached drawings has been given as a mere example of the general principles of the invention and of some of its preferential constructive configurations; other modifications or variants can be made without departing from what claimed.

What is claimed is:

1. Method for the waterproofing covering of at least one of joints and cracks in one of hydraulic structures, concrete structures and masonry structures, using a waterproofing first membrane comprising a strip of elastically yieldable synthetic material, which is positioned along a joint or crack on an existing surface of at least one of the hydraulic and masonry structure to be protected, the method comprising the steps of:

positioning at least one support element of rigid material on the existing surface of at least one of the hydraulic, the concrete and the masonry structures, to cover at least one of the joint and the crack, and to provide a supporting surface for the membrane;

anchoring said support element across at least one of the joint and the crack to allow a sliding movement in respect to said existing surface;

positioning at least one protection substrate for the membrane, over the support element;

positioning a second membrane between the at least one protection substrate and the waterproofing first membrane to allow a sliding movement of the waterproofing first membrane in respect to the support element and the existing surface;

placing the waterproofing first membrane over the protection substrate and the support element; and watertightly fastening peripheral edges of the waterproofing first membrane to the existing surface of at least one of the hydraulic and of the masonry structure, along the sides of at least one of the joint and the crack.

2. Method for the waterproofing of joints and cracks according to claim 1, wherein in said watertightly fastening step, the strip of the waterproofing first membrane is fastened on the side edges of the joint or crack, in a continuous way and independently from the fastening of the support element and the protection substrate for the waterproofing strip.

3. Method for the waterproofing of joints and cracks according to claim 1, wherein the protection substrate comprises at least one layer of sheet material for mechanically protecting the strip of waterproofing membrane allowing the waterproofing first membrane to slide.

4. Method for the waterproofing of joints and cracks according to claim 1, wherein said watertightly fastening step further comprises fastening the strip of waterproofing membrane to the surface of at least one of the hydraulic structure, concrete and masonry structure, independently from fastening of the support element for supporting the membrane, and independently from fastening of the protection substrate.

5. Method for the waterproofing of joints and cracks according to claim 1, wherein said at least one support element comprises first and second plates partially overlapping each other, and further comprising the step of anchoring each plate along one side edge in order to allow mutual sliding of the first and second plates.

6. Method for the waterproofing of joints and cracks according to claim 1, further comprising the steps of extending the strip of waterproofing membrane, bending and watertightly fastening the waterproofing first membrane over a foundation beam of at least one of the hydraulic, the concrete and the masonry structure.

7. Method for the waterproofing of joints and cracks according to claim 1, wherein the step of watertightly fastening comprises pressing the peripheral edges against the existing surface of at least one of the hydraulic and masonry structure using anchoring metal profiles and by a previous regularisation of the contact existing surface.

8. Method for the waterproofing of joints and cracks according to claim 7, wherein the contact existing surface is regularized by spreading of a resin.

9. Method for the waterproofing of joints and cracks, according to claim 7, wherein the watertightly fastening step includes fastening the edges of the strip of waterproofing membrane to the existing surface of at least one of the hydraulic, concrete and the masonry structure, by the interposition of a watertight gasket.

10. Method for the waterproofing of joints and cracks according to claim 1, wherein the protection substrate is made of geosynthetic material.

11. Method for the waterproofing of joints and cracks according to claim 10, wherein the protection substrate is a geotextile having a weight from 0.5 to 3 kg/m.

12. Method for the waterproofing of joints and cracks according to claim 1, wherein the strip of waterproofing membrane and the substrate consist of a synthetic geomembrane having a low water permeability.

13. Method for the waterproofing of joints and cracks according to claim 1, further comprising the step of providing an independent rigid protection shield in front of, and spaced apart from the strip of waterproofing membrane.

14. Method for the waterproofing of joints and cracks according to claim 13, wherein the protection shield is slidably fastened to slide in respect to the existing surface.

15. Method for the waterproofing of joints and cracks according to claim 13, wherein the protection shield extends beyond lateral edges of the strip of waterproofing membrane.

16. Method for the waterproofing of joints and cracks in hydraulic structures according to claim 1, further comprising the step of connecting the waterproofing strip of the membrane for at least one of the joint and the crack on the existing surface to a waterproofing element of a foundation beam which extends in the underlying ground.

17. Method for the waterproofing of joints and cracks according to claim 1, further comprising the steps of providing an injection hole in the existing surface, and injecting a sealing material into said hole to intercept at least one of the joint and the crack, and watertightly anchoring the edges of the strip of waterproofing membrane, in correspondence with the hole.

18. Method for the waterproofing of joints and cracks according to claim 1, further comprising the an intermediate protection substrate positioned between the waterproofing membrane and the support element; and fastening element for water tightly fastening the waterproofing membrane to the existing surface on both sides of the elastically yieldable material.

19. Method for the waterproofing of joints and cracks according to claim 1, further comprising the step of placing said strip of elastically yieldable synthetic material for a waterproofing membrane over at least one of joints and cracks in at least one of hydraulic structures, concrete structures and masonry structures.

20. Method for the waterproofing of joints and cracks in hydraulic structures according to claim 1, further comprising the step of connecting the waterproofing strip of the membrane for at least one of the joint and the crack on the existing surface to a waterproofing element of a grout curtain.

* * * * *

UNITED STATES PATENT AND TRADEMARK OFFICE

CERTIFICATE OF CORRECTION

PATENT NO. : 6,619,879 B1
DATED : September 16, 2003
INVENTOR(S) : Alberto Scuero It is certified that error appears in the above-identified patent and that said Letters Patent is hereby corrected as shown below:

Title page,
Item [73], Assignee, change "Capri" to -- Carpi --.

Column 10,
Line 6, rewrite claim 18 as follows:

-- 18. Method for the waterproofing of joints and cracks according to claim 1, further comprising the step of placing said strip of elastically yieldable synthetic material for a waterproofing membrane over contraction joints in one of dams, canals, tunnels, and reservoirs. --

Signed and Sealed this

Thirtieth Day of December, 2003

JAMES E. ROGAN
*Director of the United States Patent and Trademark Office*